US010077894B2

(12) United States Patent
Mjelde

(10) Patent No.: US 10,077,894 B2
(45) Date of Patent: Sep. 18, 2018

(54) ADJUSTABLE POOL LIGHT

(71) Applicant: Olaf Mjelde, Ventura, CA (US)

(72) Inventor: Olaf Mjelde, Ventura, CA (US)

( * ) Notice: Subject to any disclaimer, the term of this patent is extended or adjusted under 35 U.S.C. 154(b) by 113 days.

(21) Appl. No.: 15/130,847

(22) Filed: Apr. 15, 2016

(65) Prior Publication Data

US 2017/0299159 A1 Oct. 19, 2017

(51) Int. Cl.

| | |
|---|---|
| ***F21S 8/02*** | (2006.01) |
| ***F21V 21/14*** | (2006.01) |
| ***E04H 4/14*** | (2006.01) |
| ***F21V 31/00*** | (2006.01) |
| ***F21V 23/06*** | (2006.01) |
| *F21W 131/401* | (2006.01) |
| *F21Y 115/10* | (2016.01) |

(52) U.S. Cl.

CPC ..... *F21V 21/14* (2013.01); *E04H 4/148* (2013.01); *F21V 23/06* (2013.01); *F21V 31/005* (2013.01); *F21W 2131/401* (2013.01); *F21Y 2115/10* (2016.08)

(58) Field of Classification Search

CPC ..... F21V 21/14; F21V 31/005; F21V 23/06; F21V 31/00; E04H 4/148; F21W 2131/401; F21S 8/024

See application file for complete search history.

(56) References Cited

U.S. PATENT DOCUMENTS

| | | | | |
|---|---|---|---|---|
| 4,445,163 | A * | 4/1984 | Ziaylek, Jr. ..... | B60Q 1/0483 116/202 |
| 5,672,004 | A * | 9/1997 | Schmidt, Jr. ..... | B63B 45/02 362/287 |
| 6,152,571 | A | 11/2000 | Ruiz | |
| 8,152,334 | B2 * | 4/2012 | Krogman ..... | F21S 8/022 362/249.02 |
| 9,033,557 | B2 * | 5/2015 | Potucek ..... | F21V 21/047 362/364 |
| 2005/0036305 | A1 * | 2/2005 | Kersey ..... | A61H 33/6063 362/149 |
| 2007/0279912 | A1 | 12/2007 | Urquhart | |

* cited by examiner

*Primary Examiner* — Peggy Neils

(74) *Attorney, Agent, or Firm* — Robert J. Lauson, Esq.; Lauson & Tarver LLP

(57) ABSTRACT

A directionally adjustable pool light includes a lamp assembly having a body encircled by a collar. The collar includes a conical portion and the body partially defines a spherical space. The body has posts along an axis running centrally through the spherical space and is held against the conical portion by the posts. Rotating an adjusting screw accessible through the collar causes the body to rotate. A pivoting frame and adjustment nut couple the adjusting screw to the body, with the frame sliding relative to the body. LEDs are located substantially centrally in the spherical space, a trim cover is located over the collar, and a removable diffuser over the LEDs is surrounded by the collar.

18 Claims, 7 Drawing Sheets

ADJUSTABLE POOL LIGHT

BACKGROUND

Submersed lighting is known in the art, including light assemblies for installation in swimming pools and hot tubs. These light assemblies typically include a waterproofed light source, such as incandescent bulbs, halogen bulbs, or an LED array, sealed in a housing and installed in an enclosure below the water line. In pool and hot tub installations, the enclosure is typically embedded in a wall or floor, including flush mounted in the plaster walls of a pool. Since the enclosures are permanently installed, other than dislodging the housing to change a malfunctioning unit, these apparatus and their associated luminance are fixed in place.

An improvement in the art allows directional customization, wherein the luminance angle can be changed and set by a user according to preference. Thus, submersed lighting apparatus have been developed to alter the lamp housing angle relative to a pool wall or floor. Such apparatus can include a customized slanted fastening ring or rings under the housing that change its mounting angle, a disfavored design requiring disassembly of the apparatus, which is difficult under water. Another known method of changing an illumination angle is to provide threaded rods and clamping discs around a housing. Loosening the rods separates the clamping disks, allowing a user to tilt the housing before re-tightening the rods to secure it in place. This method is also disfavored, requiring at least partial disassembly of the unit and relying on a user's grasp to change the lamp angle which can be inaccurate, and requires touching powered components of the unit under water.

Thus it is an object of the present invention to provide an underwater light apparatus, including a light for a pool or hot tub, which is permanently installed but can be adjusted according to preference. Another object of the invention is to provide an adjustable pool light that can be adjusted without disassembly. Another object of the invention is to provide an adjustable pool light that can be accurately adjusted in different directions using a single control. Another object of the invention is to provide an adjustable pool light that remains substantially flush with a pool wall even when adjusted Another object of the invention is to provide an easily adjustable pool light with luminance that can be color customized according to user preference without disassembly. These and other objects of the invention are more fully discussed in the following summary, description and claims.

SUMMARY

In one embodiment, a directionally adjustable pool light for embedding in a swimming pool surface includes a lamp assembly with a body encircled by a collar. The collar has a conical portion, and the body at least partially defines a spherical space. The body also has posts on an axis running through the spherical space. The body is held against the conical portion by the posts. An adjusting screw accessible through the collar is coupled to the body, and rotating the adjusting screw causes the body to rotate relative to the collar.

In this embodiment the pool light may also include a housing for receiving the lamp assembly. The posts are preferably disposed in linear opposition to each other on the body, and the axis extends centrally through the spherical space. A frame may couple the adjusting screw to the body, such that rotating the adjusting screw rotates the body about the axis, and the body preferably defines the spherical space at a location adjacent the body's contact with the conical portion.

The pool light may include one or more LEDs disposed substantially centrally in the spherical space, and may include a frame that slidably engages the body such that the adjusting screw moves the frame relative to the collar. An adjustment nut may be pivotally coupled to the frame slidably engaging the body, such that the adjusting screw moves the adjustment nut relative to the collar. To present an attractive appearance, a trim cover is placed over the collar, and a removable diffuser is surrounded by the collar.

In another embodiment, a directionally adjustable pool light for installing in a pool's surface includes a lamp assembly and a housing for receiving the lamp assembly. The lamp assembly has a body and a collar for coupling the lamp assembly to the housing, the collar having a conical portion. The body also at least partially defines a spherical space with opposing posts along an axis extending centrally through the spherical space. The body is held against the conical portion by the posts and an adjusting screw, accessible through the collar, is coupled to a frame. The frame is coupled to the body so that rotating the adjusting screw causes the body to rotate about the axis relative to the collar.

In this embodiment, the body preferably defines the spherical space adjacent the body's contact with the conical portion. The pool light may have one or more LEDs disposed substantially centrally in the spherical space. In this embodiment, the frame may slidably engage the body such that the adjusting screw moves the frame relative to the collar. Preferably an adjustment nut is pivotally coupled to the frame, which slidably engages the body, and the adjusting screw moves the adjustment nut relative to the collar. A trim cover is placed over the collar, and a removable diffuser is surrounded by the collar to provide an attractive appearance.

In yet another embodiment, a directionally adjustable pool light includes a lamp assembly having a body and a collar. The collar includes a conical portion encircling the body, and the body defines a sphere which is in contact with the collar and rotates about an axis running centrally through the sphere. A frame, which couples the body to the collar rotates normal to the axis and an adjusting screw is held in the collar and coupled to the frame, so that rotating the adjusting screw causes the body to rotate about the axis relative to the collar.

DESCRIPTION

Figure 1:
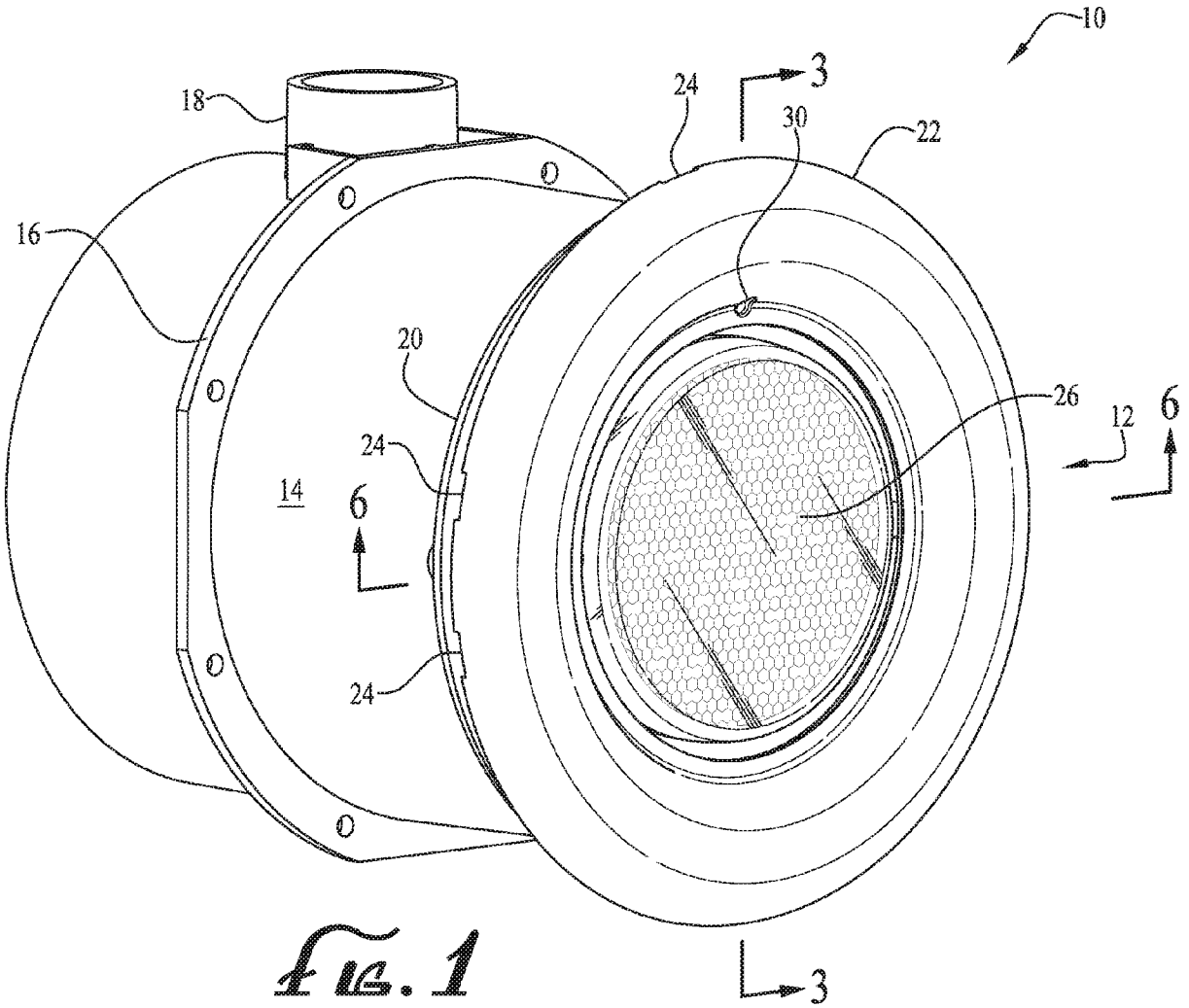
FIG. 1 illustrates a perspective view of an adjustable pool light installed in a conventional pool lamp housing.

Referring to FIG. 1 an adjustable pool light 10 comprises an adjustable lamp assembly 12 mounted in a standard pool light housing 14. The housing 14 includes a flange 16 for affixing it to a pool wall (not shown) during construction, preferably before plastering. The housing 14 also includes a conduit port 18 for coupling to an electrical supply (not shown). When the pool light 10 is installed, the lamp assembly 12 is retained by the housing 14, and a collar 20 of the lamp assembly 12 is covered by a trim cover 22 to provide a decorative appearance. In one exemplary embodiment, to create a smooth uniform appearance, the trim cover 22 may engage the collar 20 with low profile clips 24 that 'snap' the trim cover 22 in place on the collar 20.

The lamp assembly 12 includes a diffuser 26 attached or coupled to a lamp base or lamp body (body) 28 (FIGS. 2-6). The body 28 is nested in and retained by the collar 20. The diffuser 26 may blur and scatter light to help prevent illumination hot spots. A tilt adjustment control 30 allows users to change the angle of the diffuser 26 (i.e., the body 28) relative to the collar 20 and trim cover 22 to customize the direction of pool illumination according to user preference.

Figure 2:
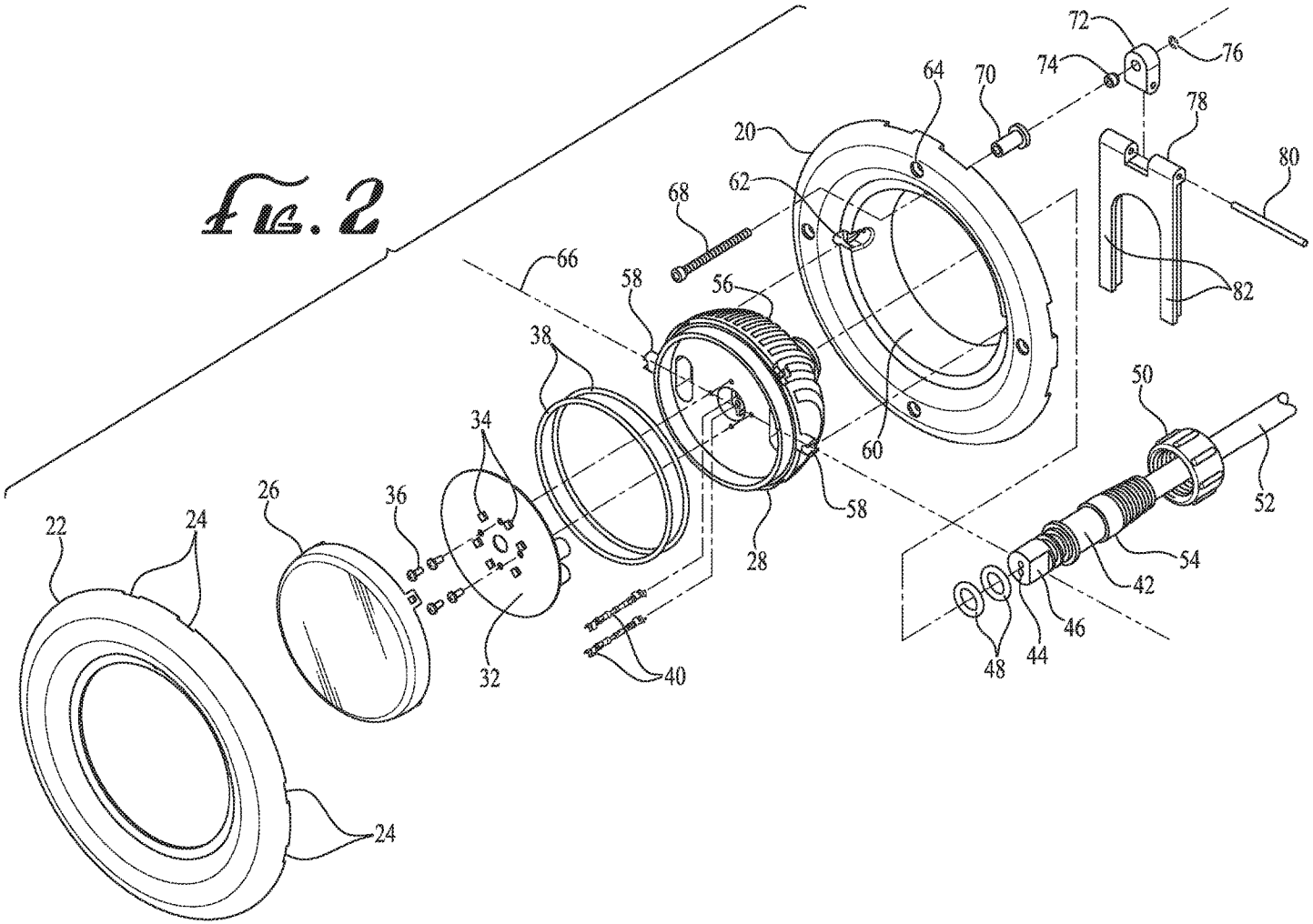
FIG. 2 illustrates an exploded view of the pool light.

Referring to FIG. 2, components of the lamp assembly 12 are shown. Nested in the collar 20 and surrounded by the trim cover 22, the diffuser 26 covers LEDs 34 on a printed circuit board (PCB) 32 retained against the body 28. The LEDs 34 on the PCB 32 supply illumination and are preferably high-output LEDs 34. PCB screws 36 secure the PCB 32 to the body 28 in the illustrated embodiment, although any effective attachment method is contemplated. To prevent water from reaching the PCB 32 and LEDs 34, lamp gaskets 38, including, for example, multiple o-ring type lamp gaskets 38 are disposed between the diffuser 26 and body 28.

A set of electric terminals 40 (pins in the illustrated embodiment) in the body 28 connect the PCB 32 to a powered connector 42 with complimentary sockets 44. The connector 42 preferably includes a keyed profile 46 for ease of installation. Like the diffuser 26 and body 28, connector gaskets 48 including, for example, multiple o-ring type connector gaskets 48 prevent water intrusion when the connector 42 is plugged and secured in the body 28. For a more secure connection, a connector nut 50 holds the connector 42 against the body 28 in a threaded engagement. The connector 42 receives power through a cable 52 that preferably includes a molded strain relief 54.

The body 28 includes fins 56 to reduce material volume and weight, and may operate as heat sinks, dissipating any excess heat from the LEDs 34. Opposing posts 58 on the body 28 engage a cowl portion 60 of the collar 20, the cowl portion 60 having slots 62 for accommodating the posts. 58. The cowl portion 60 is sized smaller than the body 28 to prevent the body 28 from passing through the collar 20 and to maintain the posts 58 in position in the slots 62. Fastener seats 64 are provided on the collar 20, for securing it to the housing 14, and are obscured by the trim cover 22. In one embodiment, when the body 28 is pressed into the collar 20 with appropriate pressure, the cowl portion 60 deforms slightly, allowing the posts 58 to snap into the slots 62. With the posts 58 anchored in the slots 62 and the body 28 engaged by the cowl portion 60, the body 28 is confined to back-and-forth movement about a central axis 66 defined by the posts 58.

Lamp assembly 12 movement about the central axis 66 is governed by an adjustment screw 68 in the adjustment control 30, extending through the collar 20. The adjustment screw 68 is retained relative to the collar 20 by a plug 70 in the collar 20. The adjustment screw 68 travels through the plug 70 to engage an adjustment nut 72 having a threaded insert 74. The adjustment nut 72 moves back-and-forth as the adjustment screw 68 turns, and includes a screw retainer 76 to prevent the adjustment nut 72 from disengaging the adjustment screw 68.

The adjustment nut 72 is hingedly coupled to a frame 78 by a hinge pin 80. The frame 78 includes rails 82 that slidably engage the body 28. When the adjustment screw 68 is rotated, the plug 70 holds its position relative to the collar 20 and the adjustment nut 72 is urged forward or backward along the adjustment screw 68, causing an accompanying movement of the frame 78 and rails 82, and corresponding rotation of the body 28 about the central axis 66

Figure 3:
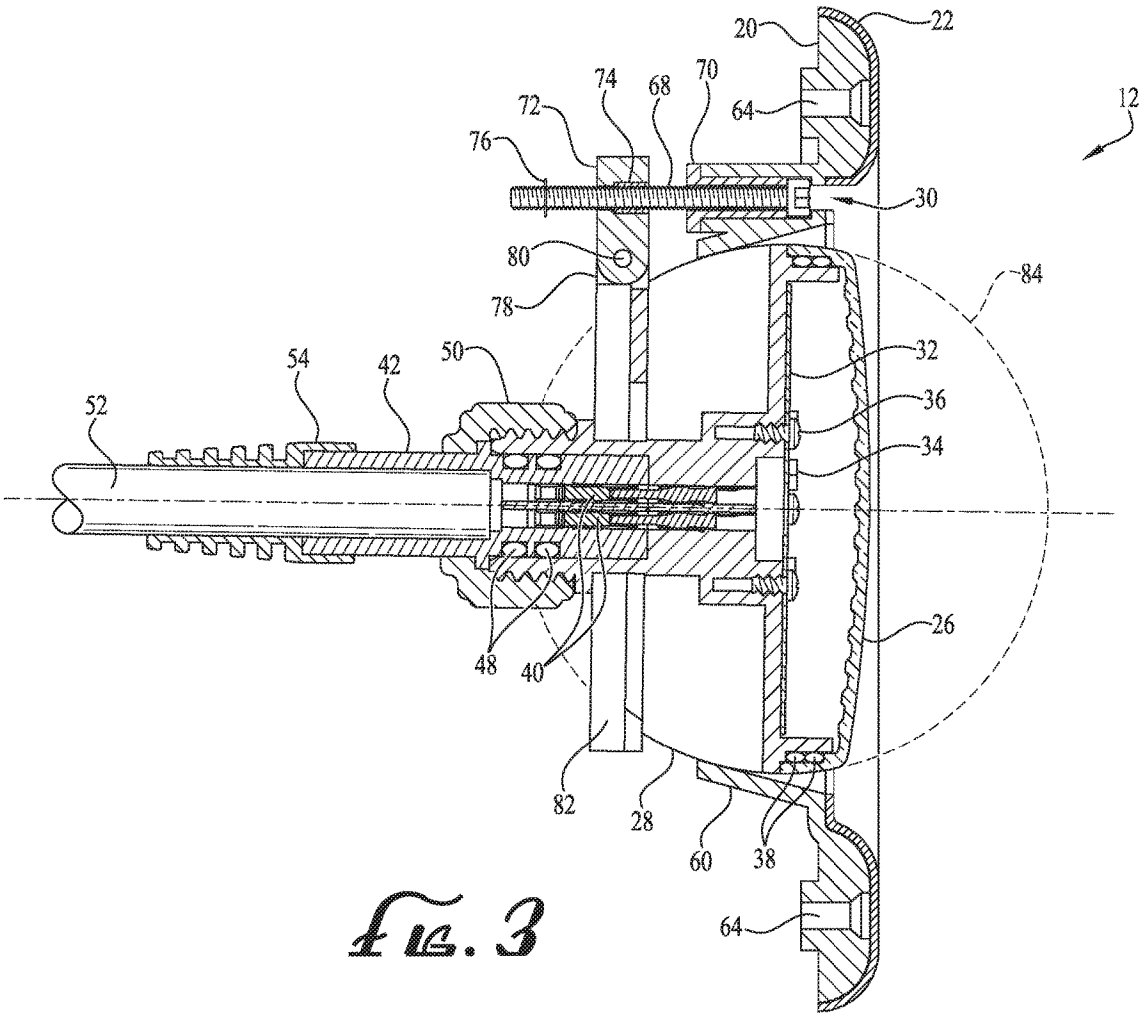
FIG. 3 illustrates a section view of the pool light with a centrally aimed lamp body.
Figure 4:
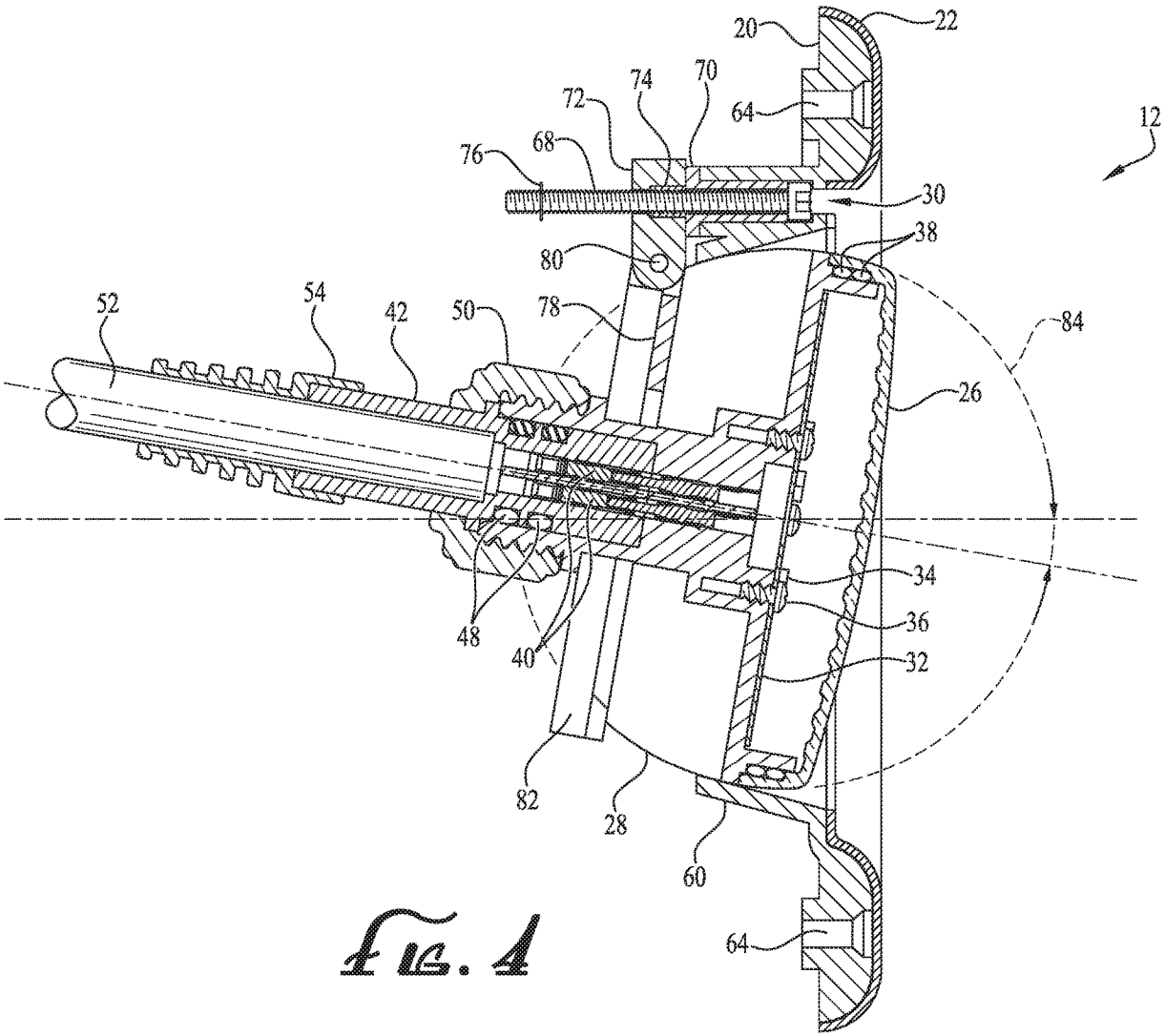
FIG. 4 illustrates a section view of the pool light with the lamp body aimed downward.
Figure 5:
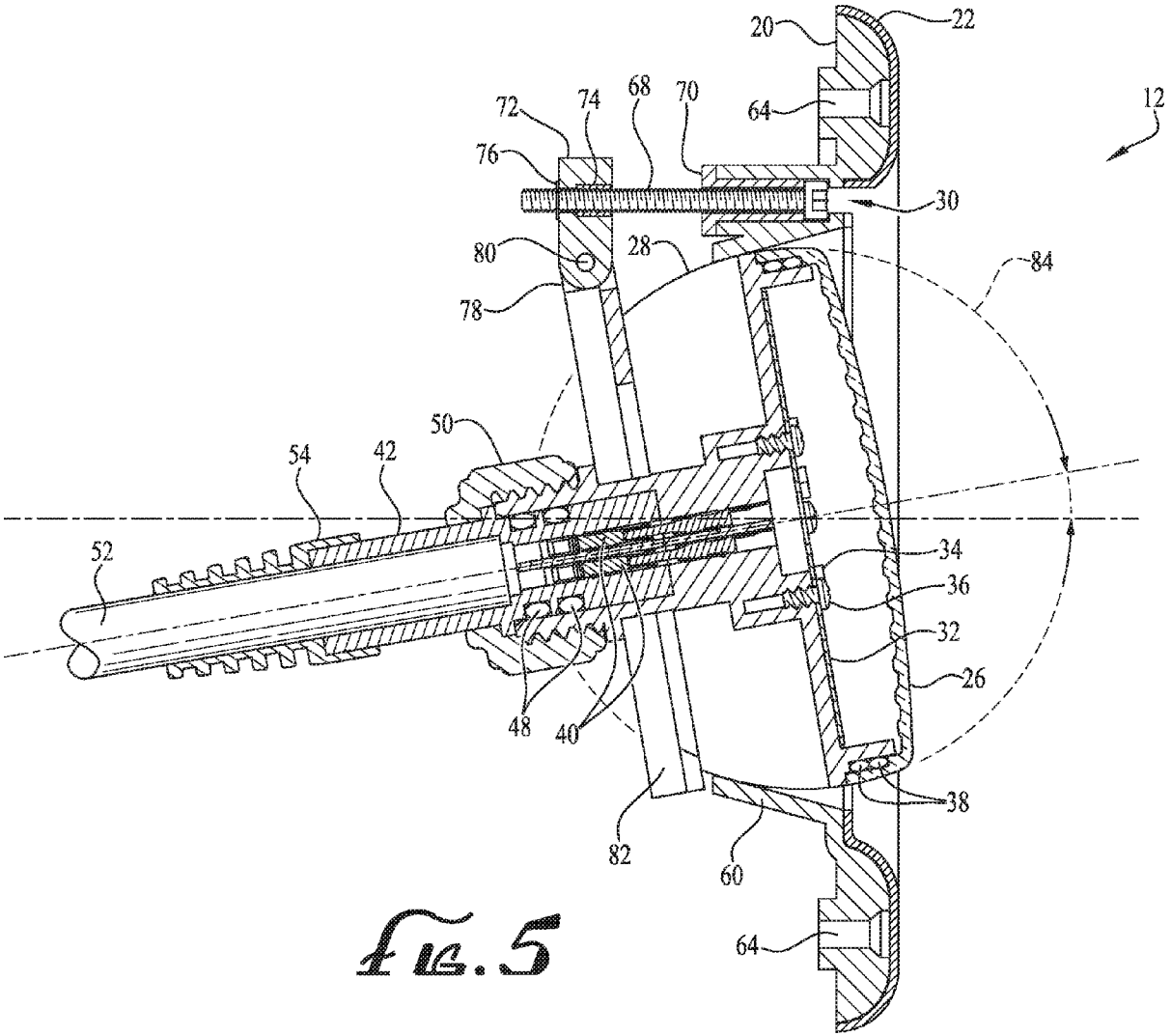
FIG. 5 illustrates a section view of the pool light with the lamp body aimed upward.

Referring to FIGS. 3-5, the pool light 10 is shown in various stages of adjustment. FIG. 3 shows the pool light 10 aimed straight forward (i.e., similar to conventional pool lights). In this position the adjustment nut 72 is disposed midway along the adjustment screw 68 and the rails 82 are substantially vertical. The body 28 defines a portion of a spherical space 84 where it engages the cowl portion 60, with the LEDs 34 disposed near the middle of the spherical space 84 and the spherical space 84 is centered on the posts 58 along the central axis 66.

FIG. 4 shows the pool light 10 adjusted to point downward. In this configuration the adjustment screw 68 has been rotated, urging the threaded insert 74 and adjustment nut 72 toward the collar 20 where they meet the plug 70 which stops them from travelling further. The adjustment nut 72 pulls the top of the frame 78, rotating the frame 78 on the hinge pin 80. As the frame 78 rotates relative to the adjustment nut 72 the rails 82 deflect and change the orientation of the body 28, in the illustrated embodiment a maximum of ten degrees downward.

FIG. 5 shows the pool light 10 adjusted to point upward. In this configuration the adjustment screw 68 has been rotated in the reverse direction, urging the threaded insert 74 and adjustment nut 72 away from the collar 20 until they meet the screw retainer 76 which stops them from travelling further. The adjustment nut 72 pushes the top of the frame 78, rotating the frame 78 on the hinge pin 80. As the frame 78 rotates relative to the adjustment nut 72, the rails 82 deflect and change the orientation of the body 28, in the illustrated embodiment a maximum of ten degrees upward. Because the posts 58 bisect the spherical space 84 and the LEDs 34 are clustered near the center of the spherical space 84, the body 28 rotates in the collar 20 changing the orientation of the LEDs 34 without changing their position in the pool light 10, thereby providing an attractive and aesthetically pleasing ocular-like tilting movement.

Figure 6:
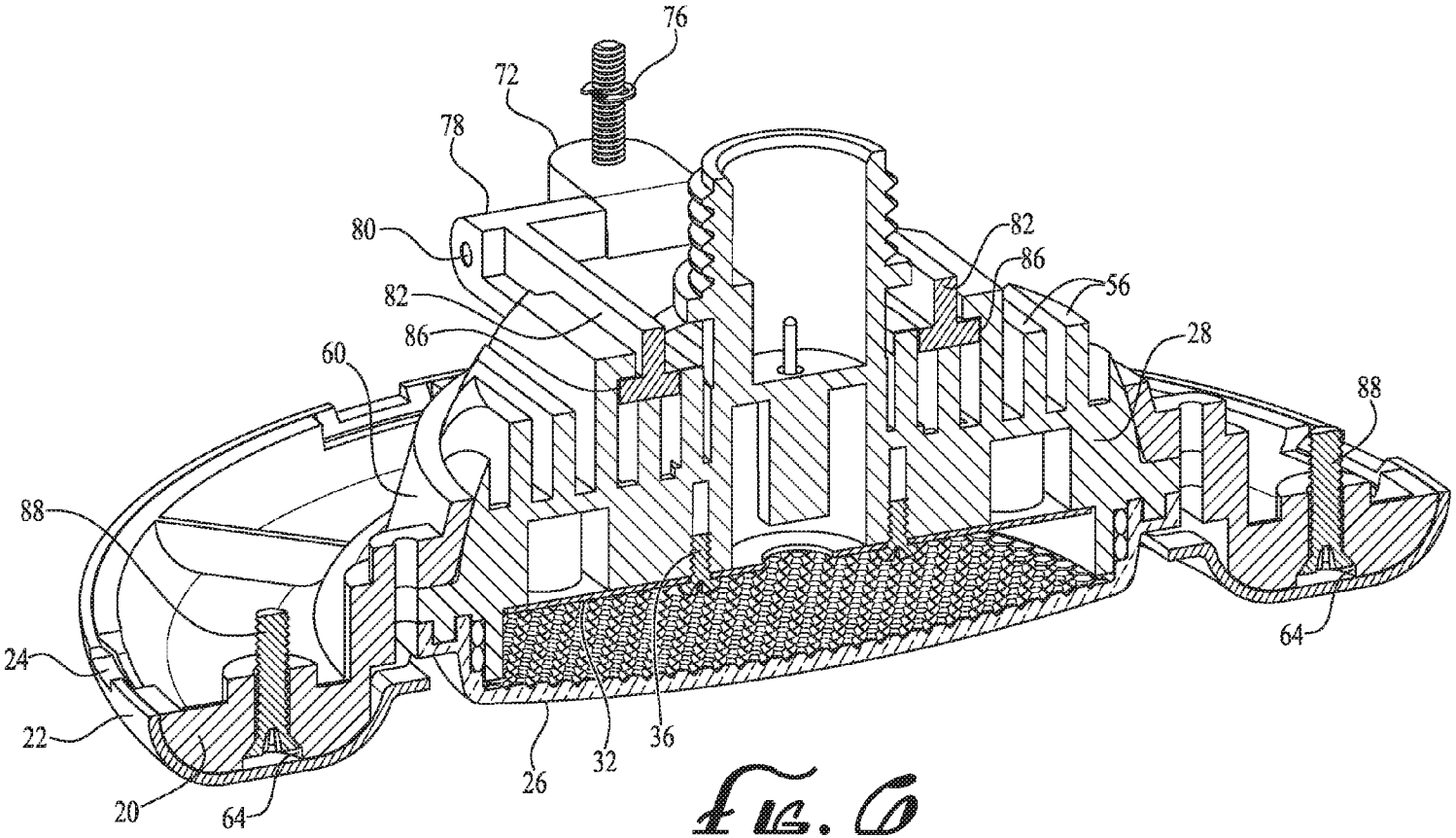
FIG. 6 illustrates a section view of the pool light showing the lamp body connected to a sliding rail of a frame.

FIG. 6 shows a cross section of the pool light 10 along the central axis 66. The rails 82 are held in a sliding arrangement in the body 28 by channels 86 formed in the fins 56. Since the rails 82 are out of alignment with the central axis 66, the channels 86 allow the rails 82 to slide up and down as they rotate the body 28. In this view the fasteners 88 for affixing the collar 20 to the housing 14 are also shown.

Figure 7A:
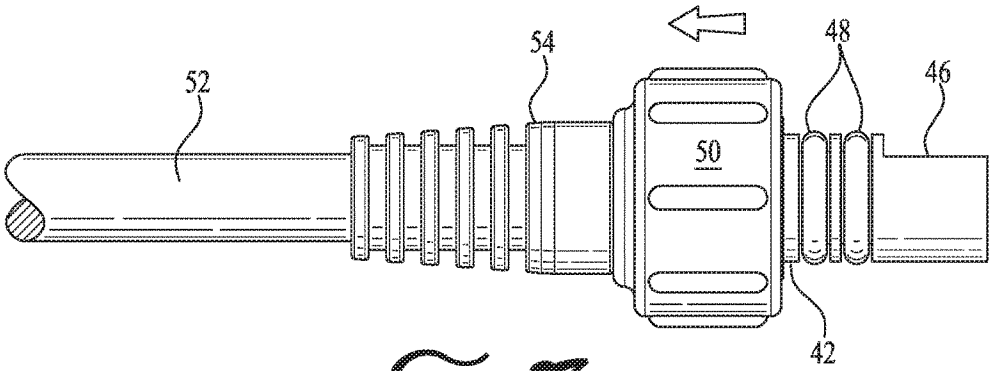
FIGS. 7A and 7B illustrate an electrical connector of the pool light with a connector nut in a disengaged and an engaged position, respectively.
Figure 7B:
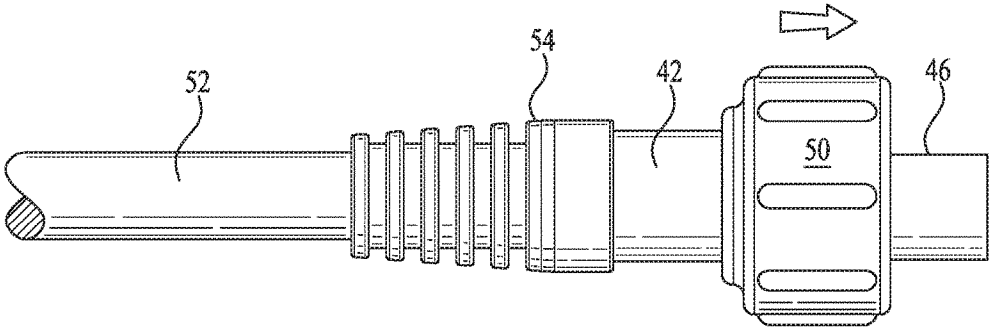

FIGS. 7A and 7B show the sliding nature of the connector nut 50 when the cable 52 is disconnected (FIG. 7A) and connected (FIG. 7B). The connector nut 50 urges the connector gaskets 48 into the body 28 for a water-proof connection with the connector 42. Preferably, the strain relief 54 serves as a stop for the connector nut 50, preventing it from sliding down the cable 52 when disconnected from the body 28.

The pool light 10 apparatus having been shown and described, its method of use will now be discussed.

To install the pool light 10, a user first anchors the housing 14 in the pool wall (or pool bottom) prior to plastering by securing the flange 16 against a mounting surface (not shown). The electrical supply is attached to the conduit port 18, with the cable 52 terminating in the connector 42. The connector 42 is inserted into the body 28 to connect the electric terminals 40, and the connector nut 50 is tightened to drive the connector gaskets 48 into the body 28 to form a water-tight connection. Any excess cable 52 is pushed into the housing 14 and the collar 20 is connected to the housing 14 by installing fasteners 88 in the fastener seats 64. The trim cover 22 is then attached over the collar 20 around the diffuser 26. The pool light 10 is then connected to a power supply for operation.

To adjust the pool light 10, a user inserts a tool (not shown) such as a screwdriver or Allen key in the tilt adjustment control 30 on the collar 20. The tool travels through the tilt adjustment control 30 until it engages the adjustment screw 68. By rotating the adjustment screw 68 in one direction, it acts on the threaded insert 74, pulling the adjustment nut 72 toward the collar 20. As the adjustment nut 72 moves toward the collar 20, the hinge pin 80 translates linear movement into rotational movement of the frame 78. As the frame 78 rotates, the rails 82 urge the body 28 into rotational movement. With the posts 58 secured in the slots 62, the body 28 moves about the central axis 66, aiming it (i.e., the LEDs 34) in an increasingly downward direction. The rails 82 slide relative to the body 28 in the channels 86, thereby avoiding binding as they rotate the body 28. When the adjustment nut 72 reaches the plug 70, the pool light 10 has reached is maximum downward angle, in one embodiment ten degrees from an un-tilted position. The pool light 10 can remain in the downward adjusted configuration indefinitely, or changed according to preference. Because the diffuser 26 is disposed on the body 28 forward of the conical portion 60 of the collar 20, the diffuser 26 can be easily removed and replaced with a diffuser 26 of a different color.

To counter-adjust the pool light 10, the user re-inserts the tool and rotates the adjustment screw 68 in the opposite direction. The adjustment screw 68 urges the threaded insert 74 and adjustment nut 72 away from the collar 20. The hinge pin 80 translates linear movement of the adjustment nut 72 into rotational movement of the frame 78. As the frame 78 rotates, the rails 82 urge the body 28 back toward an un-tilted position, and with continued rotation of the adjustment screw 68, into a new position tilted in the opposite direction (i.e., upward). During this process the body 28 continues rotating on the posts 58 along the central axis 66, and the rails 82 slide through the channels 86 as necessary. When the adjustment nut 72 reaches the screw retainer 76, the pool light 10 has reached its maximum upward angle, in one embodiment ten degrees from an un-tilted position. The pool light 10 can also remain in an upward adjusted configuration indefinitely, or changed according to preference.

The foregoing description of the preferred embodiment of the Invention is sufficient in detail to enable one skilled in the art to make and use the invention. It is understood, however, that the detail of the preferred embodiment presented is not intended to limit the scope of the invention, in as much as equivalents thereof and other modifications which come within the scope of the invention as defined by the claims will become apparent to those skilled in the art upon reading this specification.

What is claimed is:

1. A directionally adjustable pool light for embedding in a swimming pool surface, the pool light comprising:

a lamp assembly having a body encircled by a collar, the collar having a conical portion;

the body at least partially defining a spherical space and having posts on an axis through the spherical space;

the body held against the conical portion by the posts;

a frame slidably engaging the body;

an adjusting screw accessible through the collar, the adjusting screw coupled to the body; and wherein rotating the adjusting screw causes the body to rotate relative to the collar, and wherein the adjusting screw moves the frame relative to the collar.

2. The pool light of claim 1 further comprising a housing for receiving the lamp assembly.

3. The pool light of claim 1 wherein the posts are disposed in linear opposition to each other on the body.

4. The pool light of claim 1 wherein the axis is disposed centrally through the spherical space.

5. The pool light of claim 1 wherein rotating the adjusting screw rotates the body about the axis.

6. The pool light of claim 1 wherein the body defines the spherical space adjacent the body's contact with the conical portion.

7. The pool light of claim 1 further comprising an LED disposed substantially centrally in the spherical space.

8. The pool light of claim 1 further comprising an adjustment nut pivotally coupled to the frame, wherein the adjusting screw moves the adjustment nut relative to the collar.

9. The pool light of claim 1 further comprising a trim cover over the collar.

10. The pool light of claim 1 further comprising a removable diffuser surrounded by the collar.

11. A directionally adjustable pool light or installation in a pool surface, the pool light comprising:

a lamp assembly;

a housing for receiving the lamp assembly;

the lamp assembly comprising a body, and a collar for coupling the lamp assembly to the housing, the collar having a conical portion;

the body at least partially defining a spherical space and having opposing posts on an axis extending centrally through the spherical space;

the body held against the conical portion by the posts;

an adjusting screw accessible through the collar, the adjusting screw coupled to a frame;

the frame slidably engages the body; and wherein rotating the adjusting screw causes the body to rotate about the axis relative to the collar, and wherein the adjusting screw moves the frame relative to the collar.

12. The pool light of claim 11 wherein the body defines the spherical space adjacent the body's contact with the conical portion.

13. The pool light of claim 11 further comprising an LED disposed substantially centrally in the spherical space.

14. The pool light of claim 11 further comprising an adjustment nut pivotally coupled to the frame, wherein the adjusting screw moves the adjustment nut relative to the collar.

15. The pool light of claim 11 further comprising a trim cover over the collar.

16. The pool light of claim 15 further comprising a removable diffuser surrounded by the collar.

17. A directionally adjustable pool light comprising:

a lamp assembly having a body and a collar, the collar having a conical portion encircling the body;

the body defining a sphere in contact with the collar and rotatable about an axis running centrally through the sphere;

a frame coupling the body to the collar and slidably engaging with the body, the frame rotating normal to the axis; and an adjusting screw held in the collar and coupled to the frame, wherein rotating the adjusting screw causes the body to rotate about the axis relative to the collar.

18. The pool light of claim 17 further comprising an adjustment nut pivotally coupled to the frame, wherein the adjusting screw moves the adjustment nut relative to the collar.

* * * * *